United States Patent [19]

Yamashita

[11] Patent Number: 4,714,819

[45] Date of Patent: Dec. 22, 1987

[54] DIRECTLY HEATING FIXING APPARATUS HAVING CURRENT COLLECTING BEARINGS

[75] Inventor: Keitaro Yamashita, Saitama, Japan

[73] Assignee: Hitachi Metals, Ltd., Tokyo, Japan

[21] Appl. No.: 884,956

[22] Filed: Jul. 14, 1986

[30] Foreign Application Priority Data

Jul. 17, 1985 [JP] Japan ..... 60-157643
Jul. 17, 1985 [JP] Japan ..... 60-157644
Jul. 17, 1985 [JP] Japan ..... 60-157645

[51] Int. Cl.[4] ..... H05B 3/00

[52] U.S. Cl. ..... 219/216; 219/471; 439/23

[58] Field of Search ..... 219/216, 343, 469–471, 219/531; 355/3 FU, 14 FU; 191/1 A; 339/5 R, 5 M, 5 RL, 6 R, 6 RL, 8 R, 8 P, 8 PB; 432/60

[56] References Cited

U.S. PATENT DOCUMENTS

| | | | |
|---|---|---|---|
| 1,973,234 | 9/1934 | Isuvaris | 339/8 PB |
| 2,957,562 | 10/1960 | Rudisch | 339/5 R |
| 3,310,655 | 3/1967 | Hager, Jr. | 219/471 X |
| 3,417,219 | 12/1968 | Bailey | 219/471 X |
| 3,636,306 | 1/1972 | Bompus | 219/343 X |
| 4,063,066 | 12/1977 | Nagoshi | 432/60 X |
| 4,105,896 | 8/1978 | Schuster | 219/471 X |
| 4,116,422 | 9/1978 | Vogel et al. | 339/5 RL X |
| 4,362,502 | 12/1982 | Motomura et al. | 219/216 X |
| 4,395,109 | 7/1983 | Nakajima et al. | 432/60 X |
| 4,560,860 | 12/1985 | Fauser | 219/471 X |
| 4,618,240 | 10/1986 | Sakurai et al. | 432/60 X |

*Primary Examiner*—J. R. Scott
*Assistant Examiner*—A. Jonathan Wysocki
*Attorney, Agent, or Firm*—Finnegan, Henderson Farabow, Garrett & Dunner

[57] ABSTRACT

A directly heating type fixing apparatus for use in an image forming device such as an electronic copying machine, has a heating roll which includes an heat generating electric resistance layer and a toner releasing layer both formed on the surface of a cylindrical body thereof, and a pressure roll which is arranged to contact the heating roll under pressure. Current collecting bearings made of an electrically conductive material are provided on both sides of the heating roll, respectively. These current collecting bearings and the heat generating electric resistance layer of the heating roll are electrically connected with each other.

9 Claims, 3 Drawing Figures

DIRECTLY HEATING FIXING APPARATUS HAVING CURRENT COLLECTING BEARINGS

BACKGROUND OF THE INVENTION

The present invention relates to a directly heating fixing apparatus, which, in an image forming unit such as an electronic picture copying machine, facsimile, printer or the like, performs the fixing of images by passing a paper carrying non-fixed images between a pair of rolls.

Conventionally, to fix an image made of toner which is formed on a copying sheet such as a zinc oxide sensitized paper, ordinary paper, plastic sheet or the like, there is known a heating type fixing apparatus which has a heating roll and a pressurizing roll made to contact with each other under pressure and which heats and applies a pressure to a sheet to be copied by passing it between those rolls. In a conventional heating type fixing roll, a heat source such as a halogen lamp, nichrome wire or the like is provided inside of the heating roll, so that, by the radiation of the heat source, the heating roll may be heated.

However, in such heating method, time required until the surface of the heating roller has reached a predetermined temperature, e.g. 180° C. (warm up time) has been on the order of several minutes, which is a relatively long time.

Recently, to shorten the warm up time, the so-called directly heating type fixing apparatus has been proposed. In Japanese Patent Appln. Laid-Open No. 164860/1980, there is disclosed a heat emission roller in which a heat insulating layer, insulating layer, heat generating resistance layer and a protection layer are sequentially formed about a core bar. At both ends of the heat generating roller are provided electrically conductive members which are connected with the heat generating resistance layer via electrical conductors, and a plurality of arcuate sliding terminals are made to contact the electrically conductive members under pressure by means of a spring. Reduced diameter portions at both ends of the core bar are rotatably supported by means of bearing units. In such a construction as above, however, since the sliding terminals and the bearing units are separately provided, when an effective fixing width of the fixing apparatus is assumed to be constant, the overall length of the apparatus cannot but be enlarged. The above-mentioned disadvantage is serious, in view of the recent demand that the entire apparatus must be made compact.

In Japanese Patent. Appln. Laid-Open 161768/1982, a heat generating roller has been disclosed, wherein an insulating layer and a heat generating layer are sequentially formed on the outer periphery of a cylindrical body, and in which sliding rings electrically connected with the heat generating layer are provided at both ends of the roller. Sliding brushes are made to contact sliding rings under pressure, so that the current required for heating may be supplied. Though, in this heating roller, no bearing is explicitly shown, from the provision of a rotary shaft, it is considered that bearings are engaged with the rotary shaft. The above construction also exhibits the disadvantage that the heating roller is elongated by the amount of length needed for providing the bearing and the electrode portion separately. Furthermore, in this heating roller, since the area of contact between each sliding brush and the associated sliding rings is small, problems related to wearing or bad contacts tend to arise.

Furthermore, in Japanese Patent Appln. Laid-Open No. 91376/1985, sliding members for feeding current are provided in the interior of bearings which support both ends of a heating roller. In this construction, however, the structure of each bearing is complicated and is not suited for practical use.

Co-pending U.S. patent application Ser. No. 837,178 on Mar. 7, 1986, which has been assigned to the same assignee as that of the present application, is also directed to a directly heating fixing apparatus of the type as discussed in the present application.

SUMMARY OF THE INVENTION

An object of the present invention is to provide a directly heating fixing apparatus in which the overall length of a heating roll is shortened without a decrease of the effectively heated fixing width thereof so as to make the entire apparatus compact.

The directly heating fixing apparatus according to the present invention comprises a heating roll in which a heat generating electric resistance layer and a layer of a heat resistant toner releasing material are formed on the surface of a cylindrical body, and a pressure roll which is made to contact the heating roll under pressure, wherein current collecting bearings each made of an electrically conductive material are provided at both ends of the heating roll, and the current collecting bearings and the heat generating resistance layer in the heating roll are electrically connected with each other. The cylindrical body is preferably made of metal, an insulating layer being provided between the cylindrical body and the heat generating resistance layer.

Preferably, the heat generating resistance layer extends in the axial direction outwardly of the layer of the heat resistant toner releasing material and electrode rings are provided on its extensions, so that each electrode ring and the associated current collecting bearing may slidably contact with each other. Furthermore, the current collecting bearing is preferably made of graphite.

The above-described and other objects, features and advantages of the present invention will become apparent from the description of the preferred embodiment made hereinunder with reference to the appended drawings.

DETAILED DESCRIPTION OF PREFERRED EMBODIMENT

The preferred embodiment according to the present invention is now described in detail with reference to the appended drawings.

Figure 1:
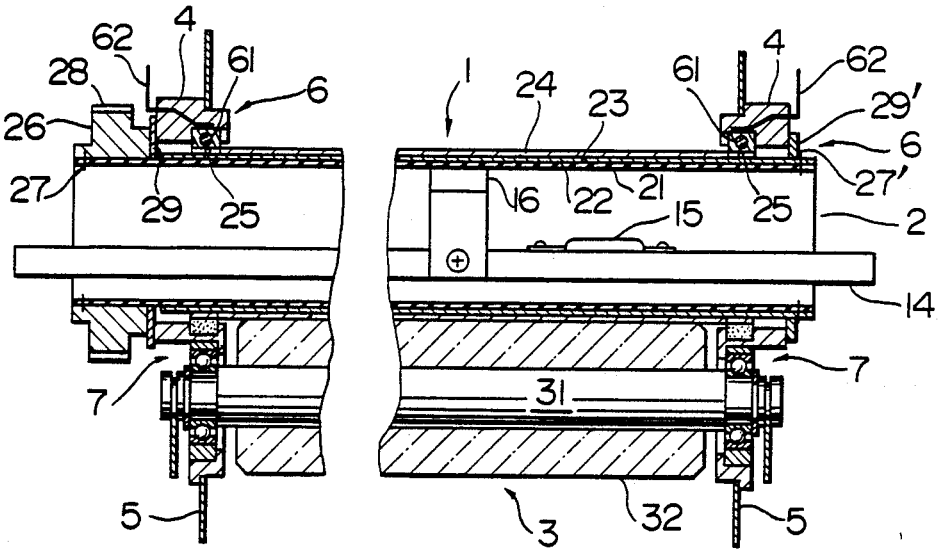
FIG. 1 is a cross sectional view of a directly heating type fixing apparatus according to an embodiment of the present invention.

FIG. 1 shows a cross sectional view of one preferred embodiment of the heating type fixing apparatus according to the present invention. The heating fixing apparatus 1 comprises a heating roll 2 and a pressure roll 3. The heating roll 2 has a hollow cylindrical body 21 made of metal, an insulating layer 22 formed on the cylindrical body, a heat generating resistance layer 23, and a layer of a heat resistant toner releasing material 24 formed on the heat generating resistance layer. The insulating layer 22 is formed over the entire length of the cylindrical body 21, while the heat generating resistance layer 23 terminates slightly inside of both ends of the cylindrical body 21 and the toner releasing layer 24 terminates somewhat inside of both ends of the heat generating resistance layer 24. At both end portions of the heat generating resistance layer 23 which are not covered with the toner releasing layer 24, electrode rings 25 are provided. The cylindrical body 21 is made of the metal of a high thermal conductivity such as an aluminum alloy, stainless alloy, iron or iron alloy or the like, to have a thickness from 0.5 to 3 mm. The insulation layer 22 is preferably made of an insulation ceramic such as $Al_2O_3$, $Al_2O_3.MgO$, $Y_2O_3$, $SiO_2$, $ZrO_2$ or their mixtures by means of an arc-plasma spraying process employing a gas such as Ar, $H_2$ or $N_2$. The thickness of the insulation layer usually amounts 50 to 500 μm (preferably 100 to 300 μm). The heat generating resistance layer 23 is also preferably made of the mixture of the fine particles of an insulation ceramic such as $Al_2O_3$ or $Al_2O_3.MgO$ with the fine particle made of an electroconductive substance having a high resistance such as NiCr, by means of a plasma spraying process. In the resistance layer 23, NiCr particles are uniformly dispersed within the ceramic as the base metal while partially contacting each other. As the resistivity of the resistance layer 23 is decreased when the content of NiCr is increased, the electric resistance of the layer 23 can be adjusted to a predetermined level by regulating the content of NiCr. The thickness of the resistance layer is preferably 50 to 250 μm and more preferably 60 to 80 μm. Since the toner releasing layer 24 directly contacts the toner on a copy paper, it has to have such a property that the toner does not fuse or stick thereto (heat resistance and low surface energy). The preferred material for this purpose is the fluororesin such as tetrafluoroethylene resin, perfluoroalchoxy resin or the like. The thickness of the toner releasing layer is preferably 10 to 50 μm. The electrode ring 25 is made of the material of a high electric conductivity, for example, graphite for current collecting brushes. Incidentally, to raise the adhesiveness between the cylindrical body and the resistance layer, a bonding layer made of the material (e.g. Ni-Al-Mo, Ni-Al alloy, Ni-Cr alloy or the like) having a coefficient of linear expansion, which magnitude is intermediate between those of the cylindrical body and the resistance layer, may be formed therebetween. The thickness of the bonding layer may be about 20 to 100 mm. Furthermore, from the standpoint of safety, another insulating layer may be formed on the resistance layer and its thickness may be 10 to 50 μm.

The pressure roll 3 has a central shaft 31 and a cylindrical pressure member 32 made of the resilient material of heat resistance such as a silicone rubber. The pressure member 32 uniformly contacts the entire effectively heated fixing region of the heating roll 2. Both ends of the shaft 31 are rotatably supported by bearings which will be described later.

Left and right bearing support members 4,4 which are integrally made of a plastic or the like are respectively fixed to left and right side plates 5,5 of the fixing apparatus, each support member 4 having a bearing portion 6 for the heating roll 2 and a bearing portion 7 for the pressure roll 3. The bearing portion 6 includes an annular current collecting bearing 61, and a terminal 62 which is connected to the current collecting bearing 61 and penetrates the support member 4. The current collecting bearing 61 is dispose in such a way that, while the heating roll 2 is rotated, it may slidably contact the electrode ring 25 constantly, it is preferred to be made of the graphite having a self-lubricating property. On the other hand, since the bearing portion 7 is required only for supporting the pressure roll 3 rotatably, it may be constituted by a known ball bearing.

As shown in FIG. 1, a gear member 26 is fixed by a pin 27 at one end of the heating roll 23 outside of the bearing portion. Teeth 28 of the gear member 26 are engaged with the teeth of an external drive unit (not shown), so that the heating roll 2 may be rotated by the external drive unit. A thrust washer 29 is provided between the gear member 26 and the bearing support member 4 for positioning the heating roll 2 in the axial direction. Also, at the other end of the heating roll 2, a thrust washer 29' which contacts the external surface of the bearing support member 4, is fixed by a pin 27'.

Figure 2:
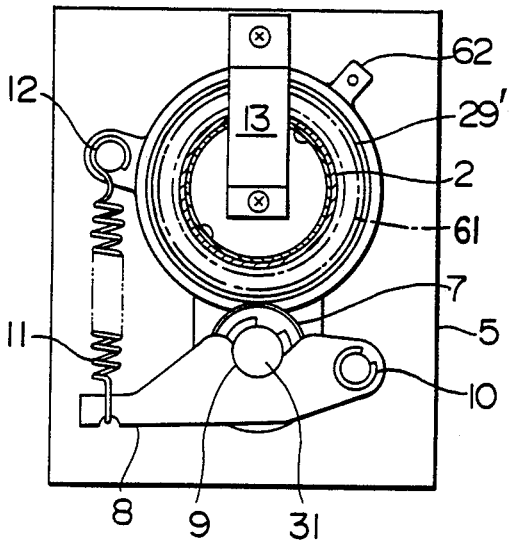
FIG. 2 is a right-hand side elevational view of the apparatus shown in FIG. 1.

As shown in FIG. 2, the shaft 31 of the pressure roll is engaged with a recess 9 formed in a lever member 8. One end of the lever member 8 is rotatably supported by a fulcrum 10, while one end of a spring 11 is connected to the other end of the lever member. The other end of the spring 11 is engaged with a pin 12 fixed to the bearing support member 4. With the above construction, the pressure roll 3 (see FIG. 1) is constantly urged to contact the heating roll 2 under pressure.

A stationary shaft 14, both ends of which are supported by respective support members 13, penetrates through the heating roll 2 (see FIG. 1), and a fuse 15 and a temperature sensor 16 are provided on the shaft 14. The temperature sensor 16 contacts, or lies closely adjacent the inner side of the cylindrical body 21 of the heating roll 2 to sense the temperature of the heating roll 2. The contact portions are preferably subjected to a mechanical processing in order to make the temperature sensor 16 and the inner surface of the cylindrical body 21 smoothly contact. The temperature sensor 16 may comprise a thermistor and is connected to an external temperature control unit (not shown) through lead lines (not shown). Incidentally, variations of the electric resistance of the heat generating resistance layer may be used for the control of the temperature without using the thermistor. The fuse 15 which is conventionally electrically connected in series with heating roll 2 is constituted to activate when the temperature exceeds a predetermined level, so that the heating roll 2 is prevented from being overheated.

Figure 3:
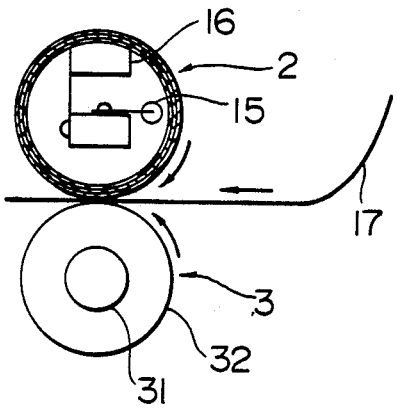
FIG. 3 is a view for illustrating the fixing operation with the apparatus of FIG. 1.

FIG. 3 shows the manner how an image is fixed to a paper with the fixing apparatus according to the present invention. The paper 17 on which a toner image has been formed is inserted between the heating roll 2 and the pressure roll 3 which are rotating in respective directions of arrows, where the paper is heated and pressed to come out of the apparatus with the toner image fixed on the paper.

As described above, in the directly heating fixing apparatus according to the present invention, since each bearing of the heating roll and the current supply device are arranged in a unit, the overall length of the heating roll can be shortened without any reduction of the effectively heated width thereof. Thus, the fixing apparatus as a whole can be made compact in size. In addition, since the heating roll is made to contact the pressure roll under pressure, each current collecting bearing is always in sufficient contact with the associated electrode ring. Thus, if the current collecting ring is formed from graphite having a self-lubricating nature, not only the rotational resistance but also the wear can be reduced.

Further, since current collecting bearings are used, there is neither the need to provide additional shafts at both ends of the cylindrical body of the heating roll, nor the need to reduce both ends of the roll in diameter. Consequently, it is possible to manufacture the heating roll inexpensively and accurately.

Furthermore, in the directly heating fixing apparatus according to the present invention, since the fuse for preventing the overheating of the heating roll is disposed inside thereof, the fuse is constantly exposed to the temperature of the heating roll without being affected by the external state, so as to prevent overheating. Additionally, since, even if the fuse is activated, no fuse element splash can occur on the outer surface of the heating roll, and no damage is caused to the toner releasing layer of the surface of the roller. When the metallic cylindrical body of the heating roll is reduced in thickness and the fuse is positioned adjcent the inner surface of the cylindrical body, the danger of overheating can be prevented more accurately.

Moreover, in the directly heating fixing apparatus according to the present invention, since the temperature sensor is disposed adjacent the inner surface of the heating roll, the sensed temperature is not affected by changes of the external temperature. Thus, the temperature of the heating roll can be precisely controlled. Furthermore, since the sensor does not contact the surface of the roll, not only the damage of the toner releasing layer on the surface but also the contamination caused by the toner can be prevented. In particular, when the cylindrical body is constituted by a metal pipe having a wall thickness of below 1 mm and the sensor is arranged to contact the inside surface of the cylindrical body, the more accurate control of the temperature is achieved.

The present invention is described heretofore with reference to the preferred embodiment, but the invention is not confined to this embodiment. It should be understood that various changes and modifications can be made within the scope of the appended claims.

What is claimed is:

1. A directly heating-type fixing apparatus having a heating roll which includes a heat generating electric resistance layer and a covering layer of a heat resistant toner releasing material, both layers being formed on a surface of a cylindrical body, and a pressure roll which is arranged to contact said heating roll under pressure, the apparatus further comprising a pair of current collecting bearings each made of an electrically conductive material provided at ends of said heating roll, respectively, said current collecting bearings supporting said heating roll against contact by said pressure roll, and said current collecting bearings and the heat generating electric resistance layer of said heating roll being electrically connected with each other.

2. The apparatus as claimed in claim 1, wherein said cylindrical body is made of a metal and an insulating layer is formed between said cylindrical body and said heat generating electric resistance layer.

3. The apparatus as claimed in claim 2, wherein said heat generating electric resistance layer extends outwardly of both ends of said toner releasing layer in the axial direction, electrode rings are provided on extensions of said heat generating electric resistance layer, and said electrode rings are slidably in contact with said current collecting bearings.

4. The apparatus as claimed in claim 1, wherein said current collecting bearings are made of a graphite.

5. The apparatus as claimed in claim 1, wherein said cylindrical heating roll is hollow and a temperature fuse operatively connected to interrupt electric power to said heating roll is provided inside of said hollow roll for the prevention of overheating.

6. The apparatus as claimed in claim 1, wherein said cylindrical heating roll is hollow, and the apparatus further includes a temperature sensor operatively connected to control the electric power to said heating roll, wherein said temperature sensor is provided in contact with an inner surface of the cylindrical body.

7. The apparatus as claimed in claim 2, wherein said current collecting bearings are made of a graphite.

8. The apparatus as claimed in claim 3, wherein said current collecting bearings are made of a graphite.

9. The apparatus as claimed in claim 1, wherein said cylindrical heating roll is hollow, and the apparatus further includes a temperature sensor operatively connected to control the electric current to said heating roll, wherein said temperature sensor is provided to lie closely adjacent an inner surface of the cylindrical body.

* * * * *